United States Patent [19]

Autio

[11] Patent Number: 4,657,634

[45] Date of Patent: Apr. 14, 1987

[54] FRAME CONSTRUCTION AND METHOD IN A PAPER MACHINE PRESS SECTION FOR FACILITATING REPLACEMENT OF PRESS ROLLS AND FABRICS

[75] Inventor: Markku Autio, Jyväskylä, Finland

[73] Assignee: Valmet Oy, Finland

[21] Appl. No.: 860,503

[22] Filed: May 7, 1986

Related U.S. Application Data

[63] Continuation-in-part of Ser. No. 727,104, Apr. 25, 1985, Pat. No. 4,608,125.

[30] Foreign Application Priority Data

| | | | |
|---|---|---|---|
| Nov. 29, 1984 | [FI] | Finland | 844693 |
| Nov. 27, 1985 | [DE] | Fed. Rep. of Germany | 3541943 |
| Dec. 13, 1985 | [FI] | Finland | 854959 |

[51] Int. Cl.[4] ..... D21F 3/04; D21G 9/00

[52] U.S. Cl. ..... 162/199; 162/200; 162/272; 162/273; 162/360.1

[58] Field of Search ..... 162/199, 200, 272, 273, 162/274, 358, 360.1

[56] References Cited

U.S. PATENT DOCUMENTS

| | | | |
|---|---|---|---|
| 3,600,273 | 8/1971 | McCarrick et al. | 162/273 |
| 4,608,125 | 8/1986 | Autio | 162/273 |

*Primary Examiner*—S. Leon Bashore
*Assistant Examiner*—K. M. Hastings
*Attorney, Agent, or Firm*—Steinberg & Raskin

[57] ABSTRACT

A frame construction and method in a paper machine press section having a compact press roll combination forming at least two press nips through which a paper web runs, the frame construction and method facilitating the removal and replacement of the fabrics and/or press rolls. The frame construction includes a front frame situated before the press roll combination and a rear frame separate from the front frame situated after the roll combination. The space above the roll combination and between the front and rear frames is opened or openable by pivoting an intermediate frame situated above the roll combination into an open position. The replacement of fabrics and press rolls are carried out by utilizing the open space obtained by pivoting the intermediate frame. The intermediate frame comprises two separate frame parts, namely, a front intermediate frame which is pivoted around horizontal articulated joints attached to the front frame, and a rear intermediate frame is pivoted around horizontal articulated joints attached to the rear frame. The intermediate frame is closed by coupling the outer parts thereof to a stationary intermediate frame part mounted, for example, on the bearing housings of the center roll of the press.

8 Claims, 3 Drawing Figures

FRAME CONSTRUCTION AND METHOD IN A PAPER MACHINE PRESS SECTION FOR FACILITATING REPLACEMENT OF PRESS ROLLS AND FABRICS

BACKGROUND OF THE INVENTION

This is a continuation-in-part of application Ser. No. 727,104 filed Apr. 25, 1985, now U.S. Pat. No. 4,608,125.

The present invention relates to a method in a compact press section of a paper machine which includes a compact press roll combination, the rolls of which form at least two press nips with each other through which a paper web runs, by which method the fabrics in the press section and/or the press rolls of the compact press roll combination can be easily replaced. The method is applied in a frame construction for the press section which includes, in the direction of the run of the paper web, a front frame situated before the roll combination and a rear frame situated after the roll combination, in which method the space above the roll combination and between the front frame and rear frame is opened by pivoting an intermediate frame arrangement into an open position to form an open space which can be used either directly or indirectly to facilitate replacement of at least the pick-up fabric, or equivalent, and of the upper fabric, if any, of the press and/or the replacement of one or more press rolls of the roll combination.

The invention also relates to a frame construction in a compact paper machine press section suitable for use in the practice of the method. The frame construction is for a press section which includes a compact press roll combination whose press rolls form at least two and preferably three or more press nips with each other, the paper web running between the press nips, preferably as a closed draw. The press section comprises, in the direction of web run, a front frame situated before the compact press roll combination, and a rear frame separate from the front frame, the front and rear frames being connected to each other by means of an intermediate frame arrangement located above the roll combination which is pivotable into an open position by means of actuating means so that a space is opened above the press roll combination which can be utilized when the press rolls, and prefereably also the press fabrics, are being replaced.

In the frame construction of conventional compact press sections of paper machines, such as in the SYMPRESS paper machine press section available from Valmet Oy of Finland, front and rear frames are provided before and after the compact press roll combination which are permanently connected to each other by horizontal beams located at both the operating and service sides of the paper machine. As used herein, "front frame" means the frame part that is situated before the compact press roll combination in the direction of web run through the press section and on which the upper press roll, conventionally a suction roll, of the first press nip is usually mounted. Correspondingly, "rear frame" means the frame part which is situated after the press roll combination.

Conventional frame constructions for compact paper machine press sections present difficulties in connection with the replacement of the press fabrics and press rolls. These problems have become more serious as the widths of the paper machines have increased since the press rolls are longer and heavier. Moreover, additional problems have been created by the increasing use of press fabrics formed of plastic materials. When formed of plastic, the press fabrics tend to be substantially rigid in the transverse direction which prevents the press fabrics from being compressed into a small volume, since this would cause the fabrics to become wrinkled and therefore not useable.

In an attempt to overcome the problems described above, Beloit Corporation of Beloit, Wis. has suggested a frame construction, designated as its "flip-top" construction, wherein either the top part of the front frame or the top part of the rear frame can be opened by rotating it about a pivot shaft whose axis is parallel to the transverse direction of the paper machine and which is situated above the press rolls. As a consequence of this construction, the two top parts of the frames cannot be opened at the same time.

In order to replace the pick-up fabric of a press section incorporating a "flip-top" frame construction, which fabric usually functions as the press fabric in the first and second press nips, the top part of the front frame is opened. During this procedure, however, the top part of the rear frame must be locked since the top part of the front frame, when opened, is supported on the top part of the rear frame. In a corresponding manner, the top part of the rear frame can be opened, such as in connection with the replacement of the press fabric in the third press nip, only when the top part of the front frame is closed and locked in position. The lower fabric of the first nip, which runs mainly in the basement space, is replaced by means of conventional arrangements.

The "flip-top" frame construction described above can be characterized as a type of "drawbridge" which is openable at an articulated joint which is situated in the middle of the drawbridge directly above the conpact roll combination and wherein only one-half of the bridge can be opened at any one time.

In applicant's application Ser. No. 727,104, filed Apr. 25, 1985, now U.S. Pat. No. 4,608,125, a method and press section for applying the method are disclosed in which a space situated above the press roll combination and between the front and rear frames is opened or openable by pivoting an intermediate frame into an open position. The pivoting is performed around an articulated joint associated with the rear frame at the side of the roll combination and the open space is utilized, directly or indirectly, in the replacement of at least the pick-up fabric and the upper fabric of the press and/or in the replacement of one or more press rolls of the roll combination.

SUMMARY OF THE INVENTION

An object of the present invention is to provide an improvement in the method and apparatus disclosed in applicant's application Ser. No. 727,104 filed Apr. 25, 1985, now U.S. Pat. No. 4,608,125, and to provide an alternative method and press section frame construction for applying the method.

Another object of the present invention is to provide a frame construction of a press section which can be opened in a more simple and rapid manner than that of the Beloit "flip-top" construction.

Briefly, in accordance with the present invention, these and other objects are attained by providing a method for replacing fabrics and/or press rolls in the press section of a paper machine wherein the intermediate frame comprises two separate frame parts, namely, a front intermediate frame and a rear intermediate frame, the front intermediate frame being pivoted about horizontal articulated joints associated with the front frame, the rear intermediate frame being pivoted around horizontal articulated joints associated with the rear frame. The outer parts of the front and rear intermediate frames, relative to their points of articulation, are coupled by means of connecting parts to a stationary intermediate frame part.

The frame construction of a press section in accordance with the invention is characterized in that the intermediate frame arrangement is formed of two parts which are separately pivotable into opened and closed positions. In particular, the intermediate frame arrangement comprises a front intermediate frame which is attached to the front frame by means of horizontal articulated joints, and a rear intermediate frame which is attached to the rear frame by means of horizontal articulated joints. The front and rear intermediate frames can, in their closed positions, be fixed by means of locking parts to a stationary intermediate part of the intermediate frame arrangement. Each of the front and rear intermediate frames are provided with its own actuating means by means of which it can be opened and closed.

The present invention differs from the method and frame construction disclosed in applicant's application Ser. No. 727,104 filed Apr. 25, 1985, now U.S. Pat. No. 4,608,125, in that in accordance with the present invention, the intermediate frame comprises two pivoting parts, one of which is pivotally connected to the front frame and the other of which is pivotally connected to the rear frame, and wherein the intermediate frame can be locked in the closed position by means of locking members situated at the outer ends of the pivoting intermediate frame parts, the locking members being coupleable onto a suitable stationary frame part which preferably comprises components associated with the frames in which the journal bearings of the center roll of the press are mounted.

Comparing the present invention to the "flip-top" construction of Beloit Corporation, the present invention can be characterized as a "drawbridge" construction which is openable about articulated joints placed at both ends of the drawbridge so that, if necessary, both halves of the drawbridge can be opened at the same time into the open position thereby rendering the construction simpler in construction and use and openable in a more rapid manner.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
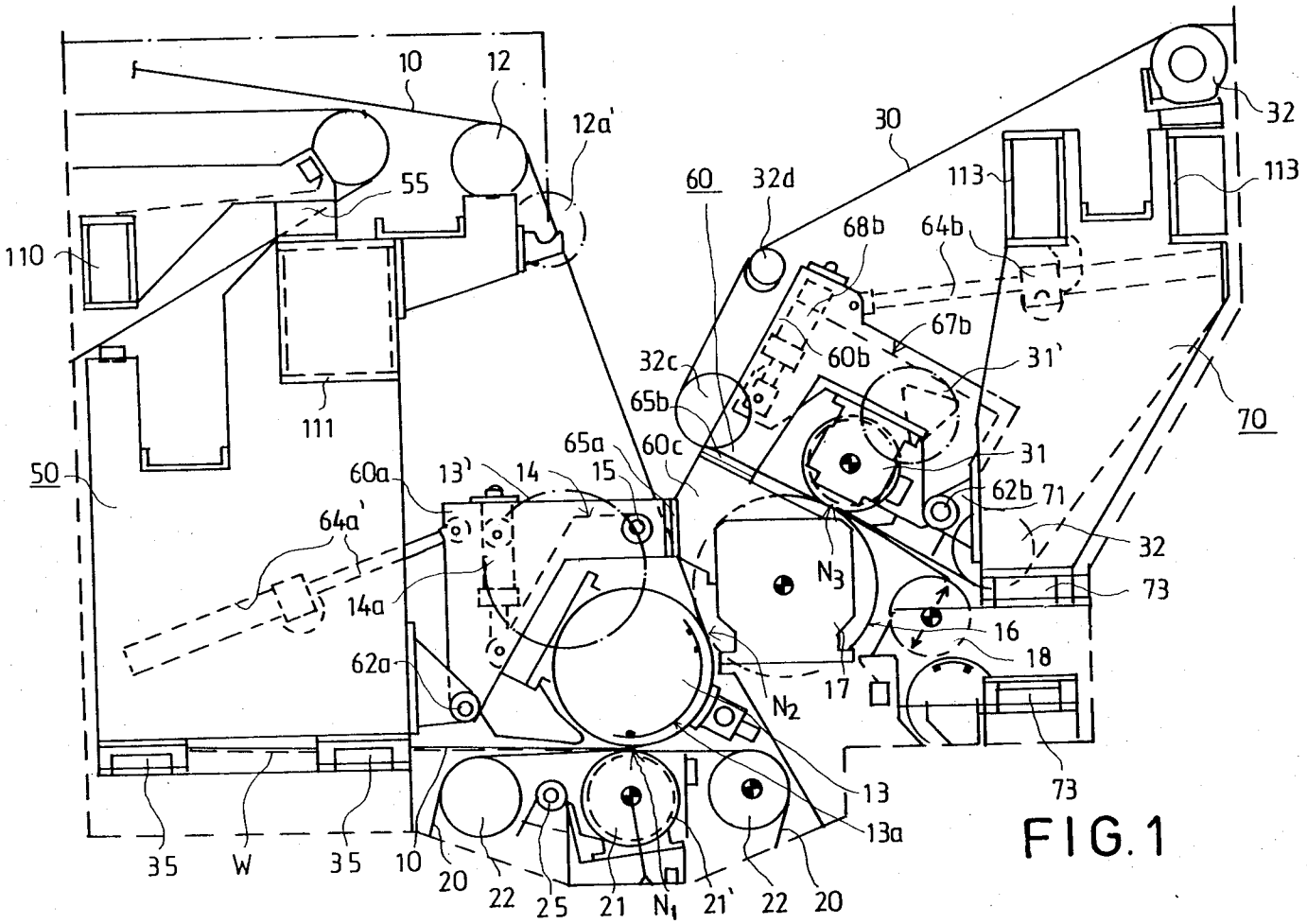
FIG. 1 is a side elevation view of a press section of a paper machine in accordance with the invention and illustrating the intermediate frame arrangement in the closed position.
Figure 2:
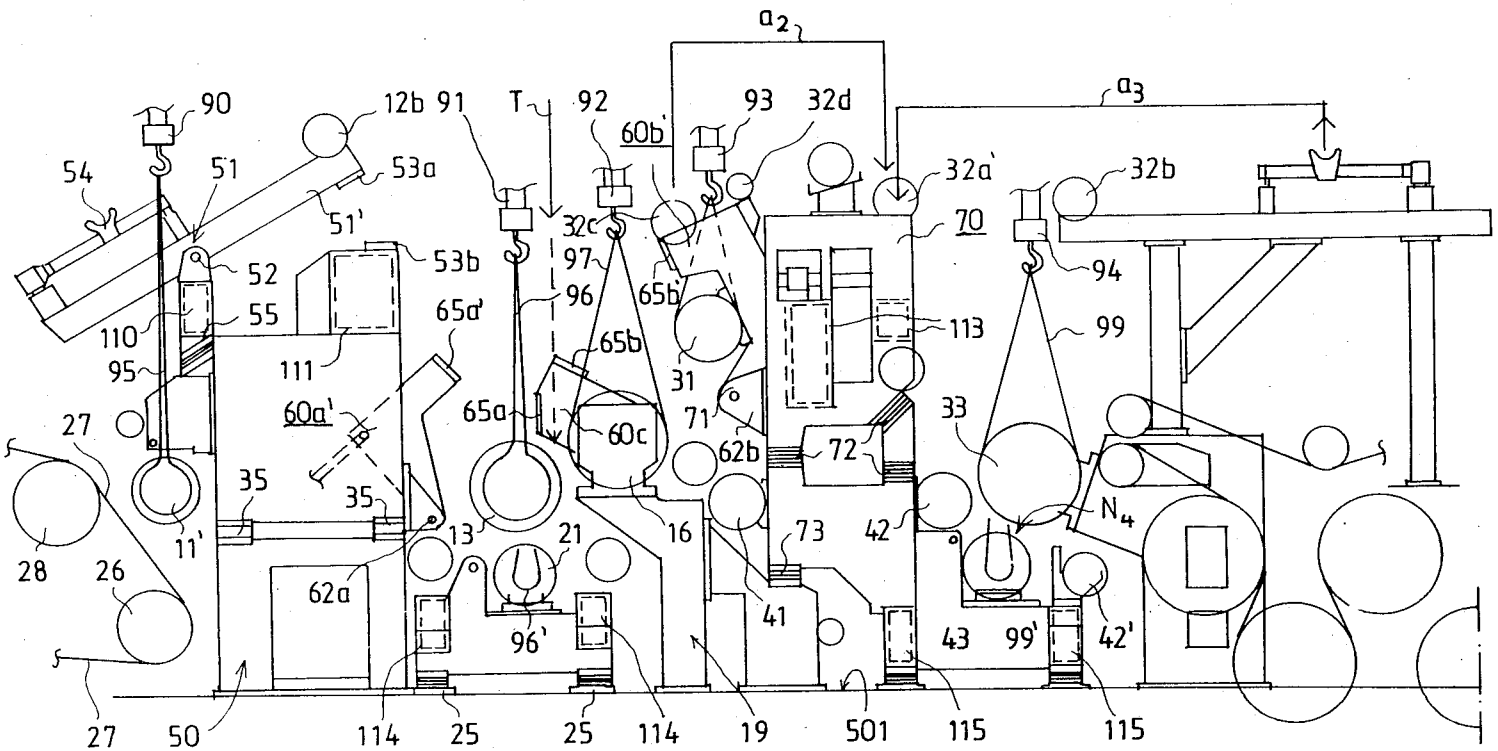
FIG. 2 is a side elevation view of the press section illustrated in FIG. 1 illustrating the replacement of press rolls while the intermediate frame arrangement is in its open position.
Figure 3:
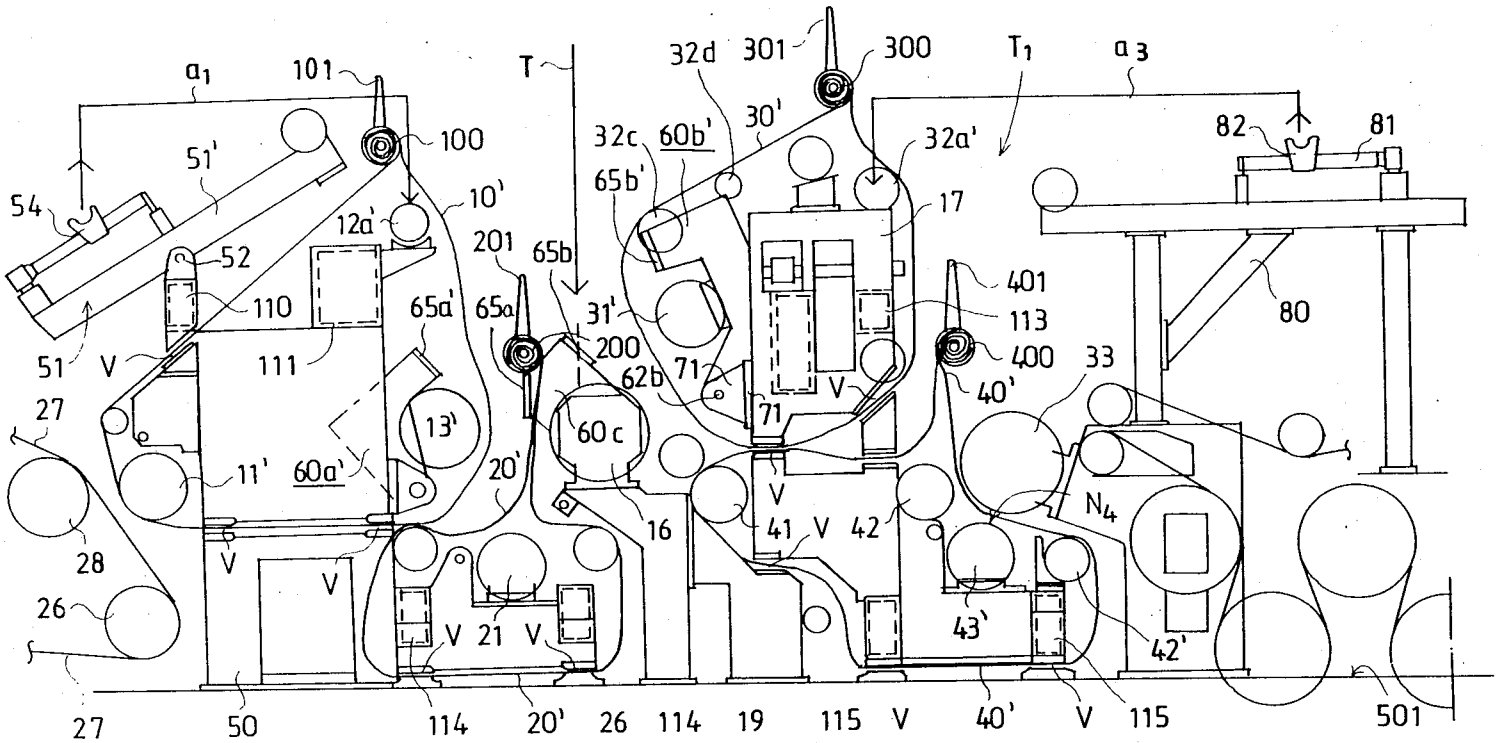
FIG. 3 is a side elevation view of the press section illustrated in FIGS. 1 and 2 and illustrating the replacement of the pick-up and press felts of the press section.

Referring now to the drawings wherein like reference characters designate identical or corresponding parts throughout the several views, the press section shown in FIGS. 1, 2 and 3 comprises a closed press roll combination including rolls 13, 16, 21 and 31 which together form three successive press nips $N_1$, $N_2$ and $N_3$ between them. The press section also includes a fourth, separate press nip $N_4$ formed between press rolls 33 and 43 (FIGS. 2 and 3). The press section includes first and second fabrics (usually felts) 10 and 20 which run through the first press nip $N_1$. The first fabric 10 acts as a pick-up fabric and also as a press fabric in the second press nip $N_2$. A third press fabric 30 runs through the third press nip $N_3$ and a fourth press fabric 40 comprises a lower press fabric and passes through the fourth press nip $N_4$.

A pick-up roll 11 is situated within the loop of the first fabric 10. Pick-up roll 11 has a suction zone which acts to transfer the web from the forming fabric 27 onto the run between rolls 11 and 13. Fabric 10 is guided by guide rolls 12. The run of second fabric 20 is guided by guide rolls 22 while the run of the third fabric 30 is guided by guide rolls 32. The fourth fabric 40 acts to shift the web W from the point facing the transfer roll 18 into the last press nip $N_4$ and is guided by suction-transfer rolls 41 and 42 as well as by guide rolls 42'.

The run of the web W from the pick-up point P through the press section is as follows. The suction sector of the pick-up roll 11 detaches the web W from the wire 27 and attaches it onto the bottom face of the fabric 10 on which the web W passes through the twin-fabric nip $N_1$. The lower roll 21 of nip $N_1$ is provided with a hollow face 21'. After the nip $N_1$, the web W follows the first fabric under the effect of suction sector **13*a* of suction roll 13. In the second nip $N_2$, the web W is transferred onto the smooth face 16' of center roll 16 on which it is carried into the third nip $N_3$ after which the web W follows the center roll 16 and is then guided by transfer roll 18 onto the fabric 40 within the suction sector of the suction roll 41 and further onto the other suction roll 42. The web is supported by the fabric 40** as it enters the last nip $N_4$.

The construction and operation of the press section described above are generally known and are described herein merely by way of background for the invention and as an example of one type of compact press section with which the present invention can be utilized.

The method and frame construction of the invention can also be applied in a compact press section in which the web has open draws and it is understood that the press rolls can be mounted and installed in a manner different from that shown in the drawings.

The frame construction of the press section includes a front frame 50 to the top portion of which an auxiliary frame 51 is pivotally mounted by means of articulated joints 52 having a horizontal pivot axis. The guide rolls of the first fabric 10 are mounted on the auxiliary frame 51. One of the guide rolls is mounted on a tensioning device 54 in order to provide suitable tensioning of fabric 10. The front frame 50 is provided with intermediate pieces 35 and 55 which can be opened for replacing the first fabric 10.

In accordance with the invention, the frame construction includes a rear frame 70 to the front side of which a rear intermediate frame **60*b* is pivotally connected by means of a projecting part 71 so as to pivot about horizontal pivot shafts 62b. The rear intermediate frame 60b is situated partly above the compact roll arrangement 13, 16, 21 and 31. The center roll 16 of the press is journalled about a fixed axis of rotation on its own frame part 19**.

As seen in FIGS. 2 and 3, both the operation and service sides of the front frame 50, the auxiliary frame 51, and the lower frame are interconnected by cantilever beams 110, 111 and 114 which are supported at one end by traction members (not shown) on the lower beam. The plane of the floor of the paper machine building is designated 501.

As seen in FIG. 1, the intermediate frame arrangement 60 comprises two parts, namely a front intermediate frame 60a and the rear intermediate frame 60b. The front intermediate frame 60a is pivotally linked to the front frame 50 by means of horizontal articulated joints 62a. The front intermediate frame 60a is pivoted around the horizontal shafts 62a by actuating means 64a'. The front intermediate frame 60a comprises substantially V- or L- shaped lateral parts which are attached by means of a connecting part 65a to an intermediate part 60c of the intermediate frame arrangement 60. The intermediate part 60c is itself attached to bearing housings 17 fixedly mounted to the frame part 19 of the center roll 16 of the press. Intermediate frame parts 14 are attached to the front intermediate frame 60a by means of horizontal articulated joints 15 and the suction roll 13 of the press is mounted on the intermediate frame parts 14. The intermediate frame parts 14 can be pivoted relative the front intermediate frame 60a by means of power units 14a which also serve to apply a load in nips $N_1$ and $N_2$.

Still referring to FIG. 1, the rear intermediate frame 60b of the intermediate frame 60 is pivotally linked to the projecting parts 71 of the rear frame 70 by means of horizontal articulated joints 62b and can be opened and closed by actuating means 64b. The press roll 31 is journalled on the rear intermediate frame 60b by means of the frame part 67b to form the third press nip $N_3$ with center roll 16. The press roll 31 can be shifted to the open position 31' relative to the rear intermediate frame 60b by power units 68b which also serve to apply a load in nip $N_3$. The side beams of the rear intermediate frame 60b are substantially U-shaped (when viewed from the side) and are attached to the stationary intermediate frame part $60_c$ of the intermediate frame 60 at their ends opposite to the points of articulation 62b by means of a connecting part 65b when the intermediate frame 60 is in the closed position.

The intermediate frame arrangement 60 described above and shown in FIG. 1 thus comprises two frame parts 60a and 60b in addition to a stationary part 60c which interconnects the same and can be opened and closed for the purposes described above.

Replacement of the rolls of the press section in accordance with the method of the invention is illustrated in FIG. 2. The upper auxiliary frame 51 of the front frame 50 is pivoted around the pivot shafts 52 into the open position 51' by opening the joints 53a, 53b. The auxiliary frame 51 may also be stationary in which case it becomes cantilevered when the fabric 10 is replaced. In the case where the auxiliary frame 51 is pivotable as shown in FIG. 2, it does not have to be pivoted during replacement of a roll. Prior to replacing the roll, the fabric within the loop of which the roll to be replaced is situated is removed. As shown in FIG. 2, lifting ropes 95 are attached to the journals of the suction roll 11' to enable the suction roll to be lifted on the hooks 90 of a traverse crane. The suction pick-up roll 11' is then replaced in a conventional manner.

Before press rolls 13, 16, 21 and 31 are lifted, the joints 65a and 65b of the intermediate frame 60a, 60b are opened and the intermediate frames 60a, 60b pivoted from the closed position shown in FIG. 1 to the vertical-open position 60a', 60b'shown schematically in FIGS. 2 and 3. In this manner a free space T having an open top is created through which the lifting of the press rolls 13, 21, 16 and 31 can be accomplished.

The suction roll 13 of the compact press section is suspended from lifting cables 96 which are attached to the lifting hook 91. Suction roll 13 is lifted upwardly and shifted to the side of the press section while at the same time turning it in space T. Subsequently, the lower roll 21 of the first nip $N_1$ is lifted in the same way by means of lifting cables 96'. The suction roll 13 may be lifted either by its axle journals by means of a pair of lifting ropes or by a center-lifting technique by means of lifting lines.

When intermediate frames 60a, 60b are in the open positions 60a', 60b', the press roll 31 of the third press nip $N_3$ can also be replaced, also by center-lifting, by means of lifting ropes or lines 98 attached to lifting hooks 93. Prior to replacing roll 31, roll 32c is shifted along the path designated $a_2$ to a temporary holding site 32a'. After the third fabric 30 has been removed or the tensioning roll for fabric 30 shifted to the holding site 32a', a free space $T_1$ is opened above the fourth press nip $N_4$. Space $T_1$ is opened at its upper end so that the press rolls 33 and 43 can be lifted by center-lifting. In accordance with FIG. 2, the press roll 33 is lifted by lifting lines 99 attached to lifting hooks 94 while the lower roll 43 is lifted by lifting lines 99'.

The term "center-lifting" as used above means that the rolls are suspended from a single crane hook supported by lifting lines which support the roll in a downwardly opening inverted V-shape symmetrically at both sides of the vertical central plane. The centerlifting technique has the advantage that the roll can be pivoted in the horizontal plane around its vertical central axis which facilitates the shifting of the rolls even in crowded conditions. On the other hand, where a roll is lifted by its axle journals, the longitudinal direction of the roll usually remains fixed since the operation of two cranes in cooperation is a difficult and dangerous procedure.

The replacement or servicing of rolls 11, 13, 21, 31, 33 and 43 has been described above in connection with FIG. 2. In practice, however, it is usually the case that only a single roll requires replacement or servicing at any one time in which case only the necessary fabrics are removed and the necessary frame parts opened.

Referring to FIG. 3, the replacement of all of the fabrics 10, 20, 30 and 40, is illustrated. It is understood, however, that it is not always the case that all of the fabrics are replaced at the same time. In the replacement of the first fabric 10, the auxiliary frame 51 of the front frame 50 is pivoted about shaft 52 to the open position 51' or, in the case where the auxiliary frame 51 is stationary, it is cantilevered and the tensioning roll for fabric 10 supported on the part 54 of auxiliary frame 51 is shifted to the holding site 12a' along the path designated by arrow $a_1$.

In the replacement of the first fabric 10, the suction roll 13 is shifted to the side position 13' by pivoting the intermediate frame 60*a* to the vertical-open position 60*a'* and the intermediate pieces 35 and 55 of the front frame 50 at the service side of the machine are opened so that open gaps V are formed in the frame through which gaps the felt loop 10' is passed. In the replacement of the second fabric 20, the suction roll 13 is shifted to the side position 13', the press roll 21 is moved to the lower position, and the intermediate pieces 25 and the frame 26 are opened.

In the replacement of the third fabric 30, the intermediate pieces 72 and 73 are opened and the tensioning roll for fabric 30 is shifted along the path $a_3$ to the holding site 32*a'* located above the rear frame 70. The intermediate frame 60*b* is pivoted into the open position 60*b'* while at the same time the press roll 31 and the guide rolls 32*c* and 32*d* (FIG. 1) are also pivoted into the inner positions whereby the open space T is formed to facilitate replacement of fabric 30.

In the replacement of lower fabric 40 of the fourth press nip $N_4$, the intermediate pieces 72, 74, 75 and 45 as well as nip $N_4$ are opened, whereby the replacement of the fourth fabric 40 may be accomplished through the open top space $T_1$.

The roll of felt 400 is pushed along a rail (not shown) which is situated in the space between the intermediate pieces 72 and 74 of the machine.

Referring to FIG. 3, the roll 100 of the first fabric which is supported on a pole carried by lifting wires 101 is carried to the service side of the paper machine. A loop 10' is unwound from roll 100 which is then passed through the spaces V and through the open press nips $N_1$ and $N_2$ to its operating position around the cantilever beam 111 whereupon the roll 12*a'* is shifted to its operating position and the auxiliary frame 51' pivoted into the closed position with its joints 53*a*, 53*b* being fastened.

In the replacement of the second fabric 20, the roll 200 of the second fabric wrapped around a pole carried by wires 201 is brought to the side of the paper machine whereupon a loop 20' is unwound from roll 200 and passed through the open spaces V and through the opened first nip $N_1$ to its operating position around the cantilever beams. Preliminarily, the tensioning and alignment rolls of the fabric 20 which are situated in the basement space below the floor level 501 are shifted to the upper position below roll 21 to the level of the cantilever beams 114, such as by means of apparatus of the type disclosed in Finnish patent application No. 80 3020. At this point, the pole supporting the roll 200 is shifted on its carrying wires 201 towards the space T in the position shown in FIG. 3 whereby the second fabric 20 becomes positioned in its operating position around the cantilever beams 114 when the nip $N_2$ is opened to a sufficient extent.

In the replacement of the third fabric 30, a loop 30' is unwound from a roll 300 wound around a pole carried by wires 301. The loop 30' is passed through the spaces V around the various rolls 31, etc., situated around the cantilever beams 113.

In the replacement of the fourth fabric 40, a technique similar to the replacement of fabric 20 is utilized so that when the fourth nip $N_4$ is in the open position, a loop 40' of fabric is passed from the roll 400 carried by wires 401 around the cantilever beams 115 in the manner shown in FIG. 3.

The operations carried out in connection with the replacement of the various felts and rolls are disclosed in U.S. application Ser. No. 727,104 filed Apr. 25, 1985, now allowed.

In the manner described above, the fabrics 10, 20, 30 and 40 can be replaced by a procedure which is more advantageous than in the prior art so that during replacement of the fabrics, adequate space is available for the various operations, primarily as a result of the frame parts 60*a* and 60*b* being openable to a positon most favorable for replacement of fabrics. The frame parts 60*a* and 60*b* can be opened simultaneously or, alternatively, only one of them can be opened at any time, as required.

It is seen from FIG. 3 that at least partly due to the method and frame construction of the present invention, the rolls to be situated inside the loops of the fabrics which are replaced can be situated in a very small space close to each other so that the free loop to be unwound from the fabric rolls and which is fitted around the various rolls and cantilever beams can be made relatively small and preferably substantially drop-shaped which facilitates the insertion of the fabrics. Regarding the replacement of fabrics, the method in accordance with the invention is advantageous where the fabrics are made of plastic which cannot be wrinkled to a bundle in the lateral direction.

As noted above, the invention can also be applied to press sections of other configurations than that specifically shown and described herein. For example, the invention can be applied to press sections avialable from applicant's assignee, Valmet Oy of Finland, under the trademarks SYM-PRESS I and SYM-PRESS II, the former having only two press nips, i.e., press nips $N_1$ and $N_2$, and no separate nip $N_4$, the latter having three nips $N_1$, $N_2$ and $N_3$ without any separate nip $N_4$. In such cases, either the third and the fourth fabrics or the fourth fabric, respectively, are omitted.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a paper machine press section having a compact press roll combination including three press rolls which form at least two press nips with each other between which a web is adapted to run in a longitudinal machine direction and press fabrics passing through said press nips, a frame construction on which said press rolls are mounted, comprising:

a front frame situated before said roll combination in the direction of web run through the press section;

a rear frame separate from said front frame situated after said roll combination in the direction of web run through the press section; and an intermediate frame arrangement situated above said roll combination interconnecting said front and rear frames, said intermediate frame arrangement being pivotal from a closed position to an open position by actuating means to create an open space above said roll combination so that at least one of said press rolls and press fabrics can be removed and replaced through said open space when said intermediate frame arrangement is in said open position, said intermediate frame arrangement including, a front intermediate frame pivotally mounted to said front frame by first pivot means having an axis transverse to the longitudinal machine direction, a rear intermediate frame pivotally mounted to said rear frame by second pivot means having an axis transverse to the longitudinal machine direction, a stationary intermediate frame part located between said front intermediate frame and said rear intermediate frame, means for locking said front and rear intermediate frames to said stationary intermediate frame part when said intermediate frame arrangement is in its closed position, first actuating means coupled to said front intermediate frame for pivoting the same between closed and open positions, and second actuating means coupled to said rear intermediate frame for pivoting the same between closed and open positions;

whereby said front and rear intermediate frames are separately openable and closeable independently of each other.

2. The combination of claim 1 wherein said compact press roll combination includes a central press roll and means for mounting the same, and wherein said stationary intermediate frame part is coupled to said mounting means for said central press roll.

3. The combination of claim 2 wherein said locking means include first locking means provided on outer ends of said front and rear intermediate frames and second locking means provided on said stationary intermediate frame part, said first and second locking means adapted to lockingly engage when said intermediate frame arrangement is in said closed position wherein said intermediate frame arrangement interconnects said front and rear frames as a fixed frame unit.

4. A method for replacing one or more press rolls and/or press fabrics in a paper machine press section having a compact press roll combination including three press rolls which form at least two press nips with each other between which a web is adapted to run in a longitudinal machine direction and press fabrics passing through said press nips, said press section further including a frame construction on which said press rolls are mounted including a front frame situated before said roll combination in the direction of web run through the press section and a rear frame separate from said front frame situated after the roll combination in the direction of web run through the press section, said frame construction having a service side and an operating side, said method comprising the steps of:

providing an openable space above said compact press roll combination by arranging an intermediate frame arrangement between said front and rear frames, said intermediate frame arrangement including a front intermediate frame having inner and outer ends and pivotally mounted to said front frame at said inner end thereof by first pivot means having an axis transverse to the longitudinal machine direction, a rear intermediate frame having inner and outer ends and pivotally mounted to said rear frame at said inner end thereof by second pivot means having an axis transverse to the longitudinal machine direction, and a stationary intermediate frame part to which said outer ends of said front and rear intermediate frames are lockable to close said space, said front and rear intermediate frames being pivotable to open positions independently of each other to open said space;

opening said space by pivoting at least one of said front and rear intermediate frames; and removing and replacing one or more press rolls and/or press fabrics through said open space above said roll combination.

5. The method of claim 4 wherein said compact press roll combination includes a central press roll and means for mounting the same and wherein said stationary intermediate frame part is coupled to said mounting means for said central press roll, and further including locking means provided on said stationary intermediate frame part for locking said outer ends of said front and rear intermediate frames thereto.

6. The method of claim 4 wherein said compact press roll combination includes a suction roll forming first and second press nips with additional press rolls, said suction roll being mounted on a first frame component articulated to said front intermediate frame and wherein first power means are provided for pivoting said first frame component for loading at least one of said first and second press nips.

7. The method of claim 6 wherein said compact press roll combination futher comprises a center roll and an additional press roll forming a third press nip, said additional roll being mounted on a second frame component articulated to said rear intermediate frame and wherein second power means are provided for pivoting said second frame component for loading said third nip.

8. The method of claim 4 wherein said compact press roll combination comprises a suction roll and a center roll, and wherein said step of removing said suction and/or center roll is performed by a center-lifting technique including initially shifting the roll towards a service side of the paper machine in the axial direction of said roll and then turning the roll about a vertical central axis thereof into the machine direction, said turning being accomplished with one end of said roll being situated in said space.

* * * * *